US010503106B2

(12) United States Patent
Kato

(10) Patent No.: US 10,503,106 B2
(45) Date of Patent: Dec. 10, 2019

(54) IMAGE FORMING APPARATUS AND IMAGE FORMING METHOD

(71) Applicant: Brother Kogyo Kabushiki Kaisha, Nagoya-shi, Aichi-ken (JP)

(72) Inventor: Sadaharu Kato, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/059,103

(22) Filed: Aug. 9, 2018

(65) Prior Publication Data

US 2019/0056687 A1 Feb. 21, 2019

(30) Foreign Application Priority Data

Aug. 17, 2017 (JP) ..... 2017-157479

(51) Int. Cl.

*G03G 15/20* (2006.01)
*G03G 15/00* (2006.01)
*G03G 15/08* (2006.01)

(52) U.S. Cl.

CPC ..... *G03G 15/2064* (2013.01); *G03G 15/0865* (2013.01); *G03G 15/205* (2013.01); *G03G 15/2039* (2013.01); *G03G 15/2053* (2013.01); *G03G 15/6511* (2013.01)

(58) Field of Classification Search

CPC ..... G03G 15/2039; G03G 15/2042; G03G 15/2046; G03G 15/205

See application file for complete search history.

(56) References Cited

U.S. PATENT DOCUMENTS

2009/0290893 A1* 11/2009 Ogiso ..... G03G 15/2039 399/69
2012/0051774 A1* 3/2012 Ikebuchi ..... G03G 15/2039 399/67
2014/0133880 A1* 5/2014 Otsuka ..... G03G 15/2039 399/70

FOREIGN PATENT DOCUMENTS

JP 2001-005537 A 1/2001
JP 2007-328164 A 12/2007

* cited by examiner

*Primary Examiner* — Carla J Therrien
(74) *Attorney, Agent, or Firm* — Banner & Witcoff, Ltd.

(57) ABSTRACT

An image forming apparatus includes: a heating member configured to heat a sheet; a heat source configured to heat the heating member; a temperature sensor configured to acquire a temperature of the heating member; a switching circuit configured to supply a current to the heat source by switching a voltage inputted from an alternating-current power source between an energization state and a non-energization state; and a controller. The controller executes: print processing of forming an image on the sheet; first energization processing of supplying the current to the heat source after a printing command is received and before the print processing is started; and second energization processing of setting a duty ratio of an output current of the switching circuit based on a detection result of the temperature sensor so that the heating member has a fixing temperature and supplying the current to the heat source, in the print processing.

18 Claims, 6 Drawing Sheets

Fig. 3A

FIRST MAP (D=100%)

| ELAPSED TIME T(s) | | |
|---|---|---|
| T > 10 | 4 < T ≦ 10 | T ≦ 4 |
| FIRST PHASE CONTROL | SECOND PHASE CONTROL | WAVENUMBER CONTROL |

Fig. 3B

SECOND MAP (30% ≦ D < 100%)

| ELAPSED TIME T(s) | | |
|---|---|---|
| T > 9 | 3 < T ≦ 9 | T ≦ 3 |
| FIRST PHASE CONTROL | SECOND PHASE CONTROL | WAVENUMBER CONTROL |

Fig. 3C

THIRD MAP (D < 30%)

| ELAPSED TIME T(s) | | |
|---|---|---|
| T > 6 | 2 < T ≦ 6 | T ≦ 2 |
| FIRST PHASE CONTROL | SECOND PHASE CONTROL | WAVENUMBER CONTROL |

FIRST/SECOND PHASE CONTROL

WAVENUMBER CONTROL

IMAGE FORMING APPARATUS AND IMAGE FORMING METHOD

CROSS REFERENCE TO RELATED APPLICATION

The present application claims priority from Japanese Patent Application No. 2017-157479 filed on Aug. 17, 2017, the disclosure of which is incorporated herein by reference in its entirety.

BACKGROUND

Field of the Invention

The present invention relates to an image forming apparatus including a heating member that heats a sheet and a heat source that heats the heating member, and an image forming method using the image forming apparatus.

Description of the Related Art

There is conventionally known an image forming apparatus (see, Japanese Patent Application Laid-open No. 2001-005537) including a fixing roller, a heater provided in the fixing roller, and a temperature detection unit configured to detect a temperature in the vicinity of the heater. In this image forming apparatus, input power is controlled or regulated based on a detection result of the temperature detection unit to prevent an excessive current from flowing through the heater, which may otherwise be caused by the decrease in impedance of the heater at low temperature.

SUMMARY

In the conventional technology, however, the control is performed based on the detection result of the temperature detection unit that detects the temperature in the vicinity of the heater. This may cause the difference between an actual temperature of the heater and the temperature detected by the temperature detection unit, leading to the excessive current flowing through the heater.

In view of the above, an object of the present teaching is to satisfactorily prevent an excessive current from flowing through a heat source.

According to a first aspect of the present teaching, there is provided an image forming apparatus, including:

a heating member configured to fix a developer image on a sheet;

a heat source configured to heat the heating member;

a temperature sensor configured to acquire a temperature of the heating member;

a switching circuit configured to supply a current to the heat source by switching a voltage inputted from an alternating-current power source between an energization state and a non-energization state; and a controller configured to execute:

print processing of fixing the developer image on the sheet;

first energization processing of supplying the current to the heat source after a printing command is received and before the print processing is started; and second energization processing of setting a duty ratio of an output current of the switching circuit based on a detection result of the temperature sensor so that the heating member has a fixing temperature and supplying the current to the heat source, in the print processing, wherein, in a case that the first energization processing is started, the controller is configured to set an energization pattern based on an end-time duty ratio which is a duty ratio when the second energization processing executed last time is ended, and elapsed time which has elapsed after the second energization processing executed last time is ended.

According to a second aspect of the present teaching, there is provided an image forming method using an image forming apparatus, the image forming apparatus including: a heating member configured to fix a developer image on a sheet; a heat source configured to heat the heating member; and a switching circuit configured to supply a current to the heat source by switching a voltage inputted from an alternating-current power source between an energization state and a non-energization state, the image forming method comprising:

print processing of fixing the developer image on the sheet;

first energization processing of supplying the current to the heat source after a printing command is received and before the print processing is started; and second energization processing of setting a duty ratio of an output current of the switching circuit based on a temperature of the heating member so that the heating member has a fixing temperature and supplying the current to the heat source, in the print processing, wherein, in a case that the first energization processing is started, an energization pattern is set based on an end-time duty ratio which is a duty ratio when the second energization processing executed last time is ended, and elapsed time which has elapsed after the second energization processing executed last time is ended.

According to the first and second aspects, the temperature of the heat source at the start of the first energization processing can be estimated based on the duty ratio when the second energization processing executed last time is ended and the elapsed time that has elapsed after the second energization processing executed last time is ended. Thus, it is possible to select the energization pattern that hardly causes the excessive current flowing through the heat source.

According to the present teaching, it is possible to satisfactorily prevent the excessive current from flowing through the heat source.

BRIEF DESCRIPTION OF THE DRAWINGS

FIG. 3A depicts a first map, FIG. 3B depicts a second map, and FIG. 3C depicts a third map.

DESCRIPTION OF THE EMBODIMENTS

Figure 1:
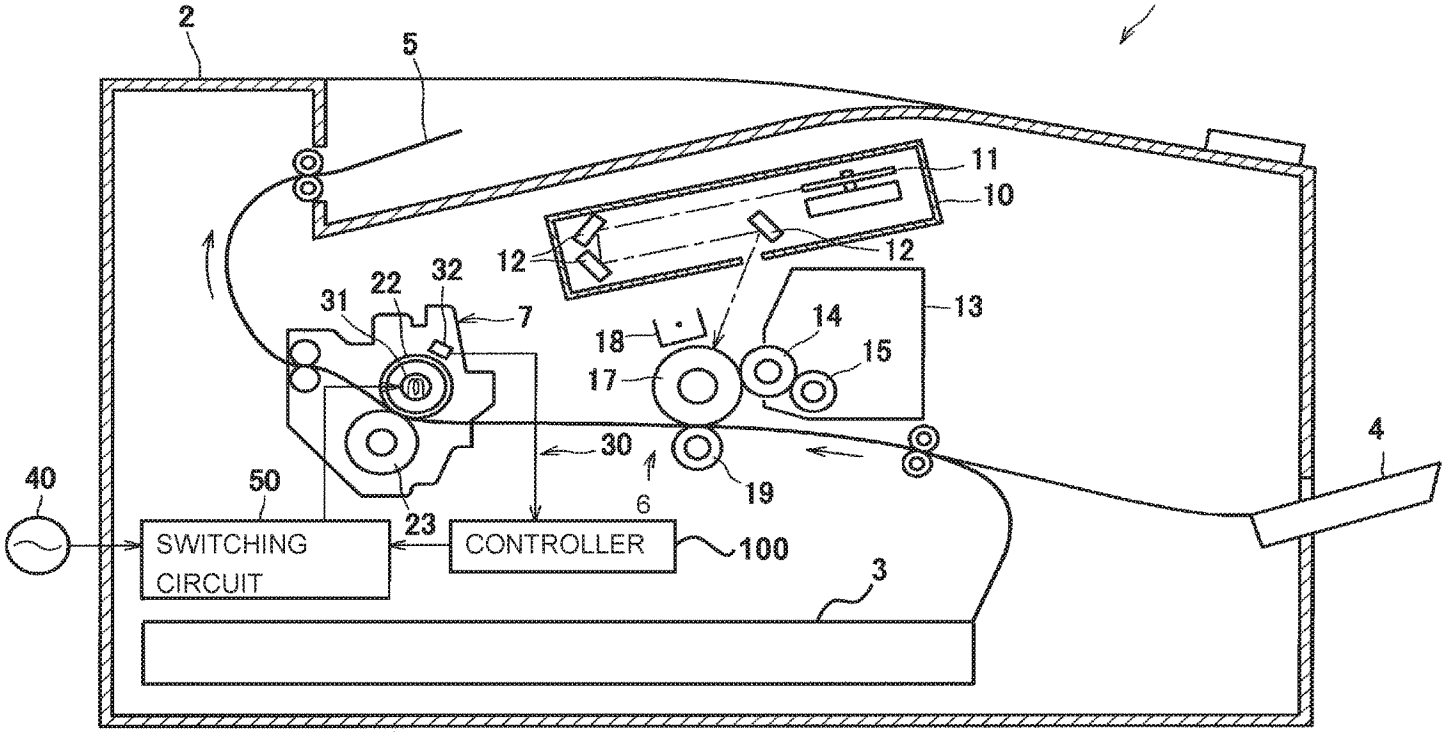
FIG. 1 is a cross-sectional view of a laser printer according to an embodiment.

Referring to the drawings, an embodiment of the present teaching is explained. As depicted in FIG. 1, a laser printer 1 is an exemplary image forming apparatus forming an image on a sheet 5. A body casing 2 of the laser printer 1 includes a feed tray 3, a manual feed tray 4, a process unit 6, a fixing unit 7, a switching circuit 50, and a controller 100.

The sheet 5 is conveyed in a conveyance direction, indicated by arrows, from the feed tray 3 or the manual feed tray 4 to the outside of the laser printer 1 via the process unit 6 and the fixing unit 7.

The process unit 6, which forms a developer image on the sheet 5, includes a scanner 10, a developing cartridge 13, a photosensitive drum 17, a charger 18, a transfer roller 19, and the like.

The scanner 10, which is disposed on an upper side within the body casing 2, includes a laser light emitting part (not depicted), a polygon mirror 11, reflection mirrors 12, and lenses (not depicted), and the like. In the scanner 10, the laser light emitted from the laser light emitting part is scanned on a surface of the photosensitive drum 17 via the polygon mirror 11, the reflection mirrors 12, and the lenses (not depicted), as indicated by a dot-dash chain line in FIG. 1.

The developing cartridge 13 includes a developing roller 14 and a supply roller 15 that supplies a toner to the developing roller 14. The developing cartridge 13 contains the toner. The developing roller 14 is disposed to face the photosensitive drum 17. Rotation of the supply roller 15 supplies the toner in the developing cartridge 13 to the developing roller 14, and the tonner supplied is held or kept by the developing roller 14.

The charger 18 is disposed on an upper side of the photosensitive drum 17 with an interval therebetween. The transfer roller 19 is disposed to face the photosensitive drum 17 on a lower side of the photosensitive drum 17.

During rotation of the photosensitive drum 17, the photosensitive drum 17 is charged, for example, with a positive polarity by use of the charger 18. The photosensitive drum 17 is exposed with the laser light from the scanner 10, forming an electrostatic latent image on the surface of the photosensitive drum 17. Then, the toner is supplied from the developing roller 14 to the electrostatic latent image on the photosensitive drum 17, forming a developer image on the photosensitive drum 17. The developer image on the photosensitive drum 17 is transferred to the sheet 5 by transfer bias applied to the transfer roller 19 while the sheet 5 passes between the photosensitive drum 17 and the transfer roller 19.

The fixing unit 7 is disposed downstream of the process unit 6 in the conveyance direction of the sheet 5. The fixing unit 7 includes a heating member 22 heating the sheet 5 and a pressure roller 23 pressed against the heating member 22. The heating member 22 is a cylindrical fixing roller. A heat source 31 heating the heating member 22 is provided in the heating member 22. As the heat source 31, it is possible to adopt a halogen lamp that includes a filament as a resistor and heats the heating member 22 by radiant heat. The switching circuit 50, which is connected to an alternating-current power source (AC power source) 40 provided outside the laser printer 1, is controlled to have an energization state or a non-energization state by the controller 100. The heat source 31 is connected to the switching circuit 50. A voltage controlled by the controller 100 depending on a temperature of the heating member 22, a power supply environment, and the like is inputted to the heat source 31. The fixing unit 7 heats the sheet 5 by use of the heat source 31 while holding the sheet 5 between the heating member 22 and the pressure roller 23, thus fixing the developer image on the sheet 5.

The fixing unit 7 includes a temperature sensor 32 acquiring a temperature of the heating member 22. The temperature sensor 32 faces in non-contact with a surface of the heating member 22. The temperature acquired by the temperature sensor 32 is outputted to the controller 100.

The controller 100 includes a CPU, a RAM, a ROM, and an input/output circuit. The controller 100 executes control by performing pieces of arithmetic processing based on a printing command outputted from an external computer, information outputted from the temperature sensor 32, a program and data stored in the ROM and the like.

The controller 100 can execute print processing, first energization processing, and second energization processing. The print processing is processing of forming an image on the sheet 5. Specifically, the print processing includes: sheet supply processing of supplying the sheet 5 from the feed tray 3 or the manual feed tray 4; charging processing of charging the photosensitive drum 17; exposure processing of exposing the photosensitive drum 17; developing processing of supplying a developer to an electrostatic latent image on the photosensitive drum 17; transfer processing of transferring a developer image on the photosensitive drum 17 to the sheet 5; and fixing processing of fixing the developer image on the sheet 5.

In this embodiment, the print processing is started when the sheet supply processing is started, and the print processing is ended when the fixing processing is ended. Namely, when printing on multiple sheets 5 is commanded in the print processing, the print processing is started when the first sheet 5 is picked up and the print processing is ended when the developer image is fixed on the last sheet 5.

The first energization processing is processing of supplying a current to the heat source 31 after the printing command is received and before the print processing is started.

The second energization processing is processing of setting a duty ratio of the current to be supplied to the heat source 31 based on a detection result of the temperature sensor 32 so that the heat source 31 has the fixing temperature and supplying the current to the heat source 31, in the print processing. Specifically, a detection temperature that is the detection result of the temperature sensor 32 may be lower than a target temperature. In that case, in the second energization processing, the duty ratio is made to be larger as the difference between the detection temperature and the target temperature is larger. When the print processing is executed, the target temperature is set to the fixing temperature at which the developer image is fixed on the sheet 5. When the detection temperature is higher than the target temperature, the controller 100 sets zero as the duty ratio. When ending the second energization processing, the controller 100 sets, as the target temperature, a standby temperature lower than the fixing temperature or 0° C. This makes the duty ratio zero immediately after the second energization processing is ended.

In the first energization processing and the second energization processing, the controller 100 controls an energization pattern including the energization state and the non-energization state. A duty ratio of the energization pattern is a ratio of an effective value of the outputted voltage, to a continuous energization state. When starting the first energization processing, the controller 100 sets the energization pattern based on a duty ratio at the end of the second energization processing executed last time and elapsed time T that has elapsed after the second energization processing executed last time is ended. The duty ratio at the end of the second energization processing is an average duty ratio in a predefined period immediately before the second energization processing is ended. In the following, the "duty ratio at the end of the second energization processing executed last time" is also referred to as an "end-time duty ratio D".

The end-time duty ratio D corresponds to a current value flowing through the filament at the end of the second energization processing. It can thus be estimated that the temperature of the filament at the end of the second energization processing increases as the end-time duty ratio D is larger.

The elapsed time T that has elapsed after the second energization processing executed last time is ended, is an index that indicates how much temperature of the filament has decreased after the second energization processing executed last time is ended. It can thus be estimated that the temperature of the filament at the start of the first energization processing decreases as the elapsed time T is longer.

An impedance of the filament of the heat source 31 decreases as the temperature of the filament is lower. In other words, it can be estimated that the impedance of the filament at the end of the second energization processing increases as the end-time duty ratio D is larger, and that the impedance of the filament at the start of the first energization processing decreases as the elapse time T is longer. When energization with a great duty ratio is performed in a state where the impedance of the filament is low, an excessive current may flow through the filament, which may cause the decrease in power supply.

Figure 2:
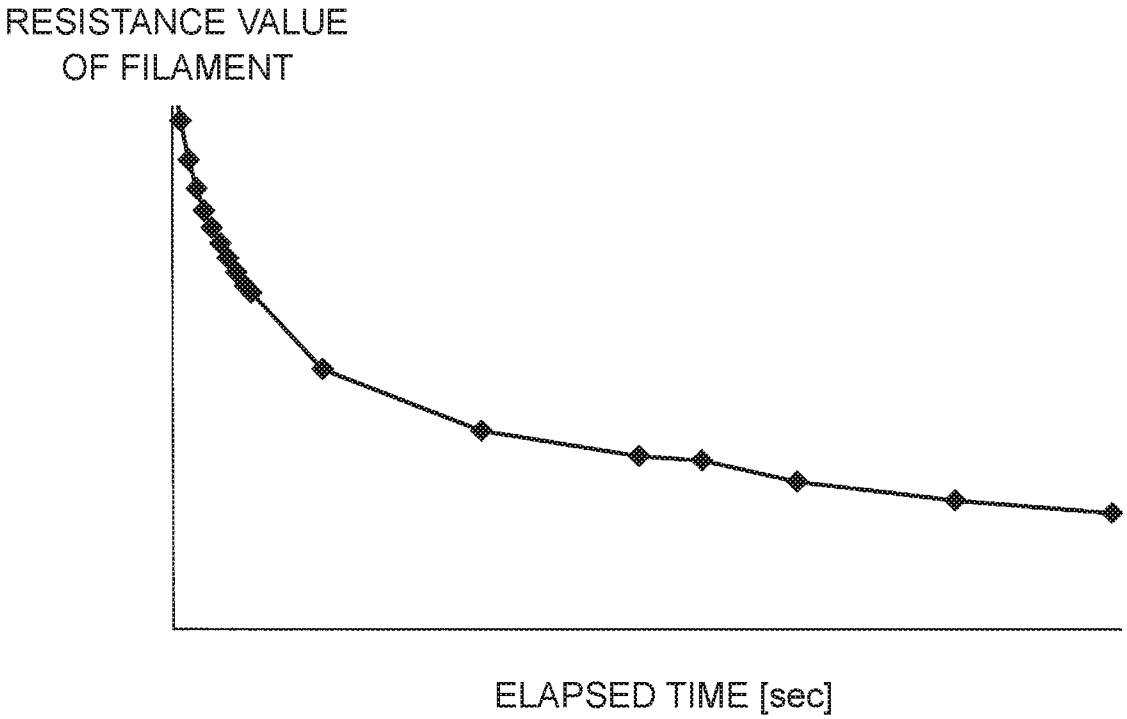
FIG. 2 is a graph indicating a correlation between a resistance value of a filament and elapsed time.

As understood from FIG. 2, the impedance of the filament decreases as the elapsed time T is longer.

As described above, the controller 100 can set the energization pattern depending on the temperature of the filament at the start of the first energization processing (i.e., depending on the impedance) by setting the energization pattern by use of the end-time duty ratio D and the elapsed time T. Specifically, the controller 100 sets the energization pattern by selecting control of the current that flows through the filament at the start of the first energization processing based on the end-time duty ratio D, the elapsed time T, and maps depicted in FIGS. 3A to 3C.

When the end-time duty ratio D is 100%, the controller 100 selects the first map depicted in FIG. 3A and then selects first phase control, second phase control, or wavenumber control based on the first map and the elapsed time T. Specifically, when the elapsed time T is equal to or less than four seconds, the controller 100 selects the wavenumber control based on the first map; when the elapsed time T is longer than four seconds and equal to or less than ten seconds, the controller 100 selects the second phase control based on the first map; and when the elapsed time T is longer than ten seconds, the controller 100 selects the first phase control based on the first map.

When the end-time duty ratio D is equal to or more than 30% and less than 100%, the controller 100 selects the second map depicted in FIG. 3B and then selects the first phase control, the second phase control, or the wavenumber control based on the second map and the elapsed time T. Specifically, when the elapsed time T is equal to or less than three seconds, the controller 100 selects the wavenumber control based on the second map; when the elapsed time T is longer than three seconds and equal to or less than nine seconds, the controller 100 selects the second phase control based on the second map; and when the elapsed time T is longer than nine seconds, the controller 100 selects the first phase control based on the second map.

When the end-time duty ratio D is less than 30%, the controller 100 selects the third map depicted in FIG. 3C and then selects the first phase control, the second phase control, or the wavenumber control based on the third map and the elapsed time T. Specifically, when the elapsed time T is equal to or less than two seconds, the controller 100 selects the wavenumber control based on the third map; when the elapsed time T is longer than two seconds and equal to or less than six seconds, the controller 100 selects the second phase control based on the third map; and when the elapsed time T is longer than six seconds, the controller 100 selects the first phase control based on the third map.

Threshold values (four seconds, three seconds, two seconds) of the elapsed time T in the respective maps for performing the switch between the wavenumber control and the second phase control are set to be larger as the end-time duty ratio D is larger. Threshold values (ten seconds, nine seconds, six seconds) of the elapsed time T in the respective maps for performing the switch between the first phase control and the second phase control are set to be larger as the end-time duty ratio D is larger.

Numerical values in the respective maps indicated in FIGS. 3A to 3C are examples. The numerical values indicated in the maps can be set as appropriate by performing an experiment, a simulation, or the like.

Figure 4A:
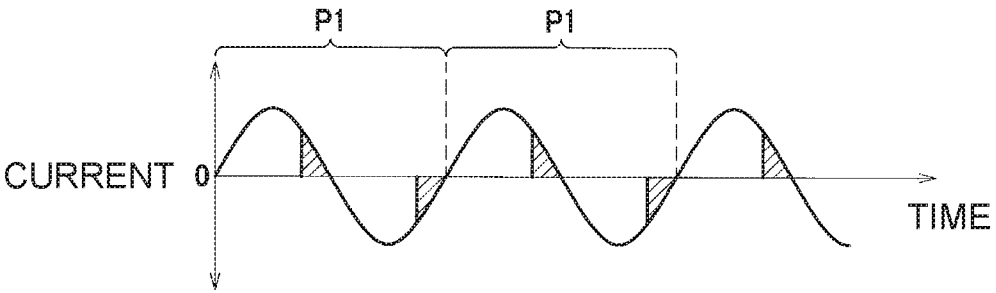
FIG. 4A depicts a first energization pattern.

When the first phase control or the second phase control is selected, the controller 100 sets, as the energization pattern, a first energization pattern P1 depicted in FIG. 4A. In other words, at the start of the first energization processing, the controller 100 sets the first energization pattern P1 as the energization pattern by executing the phase control.

The first energization pattern P1 is a pattern corresponding to a sine wave. In the first energization pattern P1, energization is caused at parts except for a peak value of the sine wave. The duty ratio of the first energization pattern P1 is less than 50% (e.g., 20%). The controller 100 executes the first phase control for a predefined time. Specifically, in the first phase control, the controller 100 executes energization control so that the first energization pattern P1 is continuously repeated, for example, 40 times.

In the second phase control, the controller 100 executes energization control so that the first energization pattern P1 is continuously repeated, for example, 20 times. Namely, in the second phase control, the controller 100 executes energization using the first energization pattern P1 for a predefined time shorter than the first phase control.

Figure 4B:
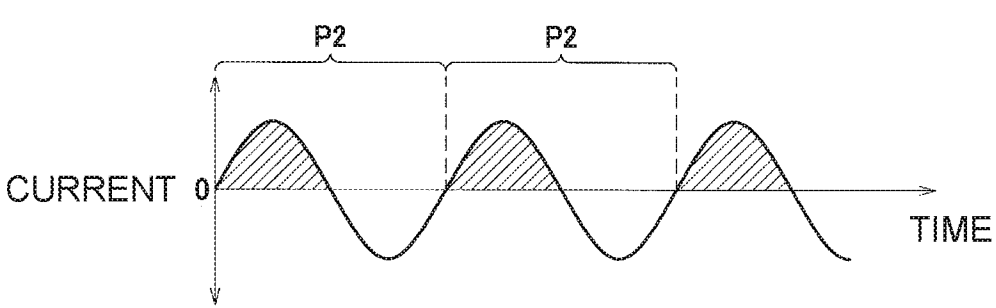
FIG. 4B depicts a second energization pattern.

When the wavenumber control is selected, the controller 100 sets a second energization pattern P2 depicted in FIG. 4B, as the energization pattern. In other words, at the start of the first energization processing, the controller 100 sets the second energization pattern P2 as the energization pattern by executing the wavenumber control.

The second energization pattern P2 is a pattern corresponding to a sine wave. In the second energization pattern P2, energization is caused at a part corresponding to a half wave of the sine wave. The duty ratio of the second energization pattern P2 is equal to or more than 50% (e.g., 50%). In this embodiment, a pattern by which energization is caused at a part corresponding to a positive half-wave of the sine wave is used as the second energization pattern P2. The controller 100 executes the wavenumber control for a predefined time shorter than cases in which the first phase control and the second phase control are executed.

As depicted in FIGS. 3A to 3C, when the elapsed time T is fixed, the control is selected depending on the end-time duty ratio D. For example, the elapsed time T may be three seconds. In that case, when the end-time duty ratio D is equal to or more than 30%, the wavenumber control is selected; when the end-time duty ratio D is less than 30%, the second phase control is selected.

In other words, when the elapsed time T is three seconds, and when the end-time duty ratio D is equal to or more than 30%, the second energization pattern P2 of which duty ratio is 50% is selected. When the elapsed time T is three seconds, and when the end-time duty ratio D is less than 30%, the first energization pattern P1 of which duty ratio is 20% is selected. Thus, when the first, second, and third maps have the same elapsed time T at the start of the first energization processing, the controller 100 makes the duty ratio of the energization pattern larger as the end-time duty ratio D is larger.

When the end-time duty ratio D is fixed, the control is selected depending on the elapsed time T. For example, the end-time duty ratio D may be 100%. In that case, when the elapsed time T is equal to or less than four seconds, the wavenumber control is selected; when the elapsed time T is longer than four seconds, the second phase control or the first phase control is selected. The controller 100 thus makes the duty ratio of the energization pattern larger as the elapsed time T is shorter, at the start of the first energization processing.

Figure 5A:
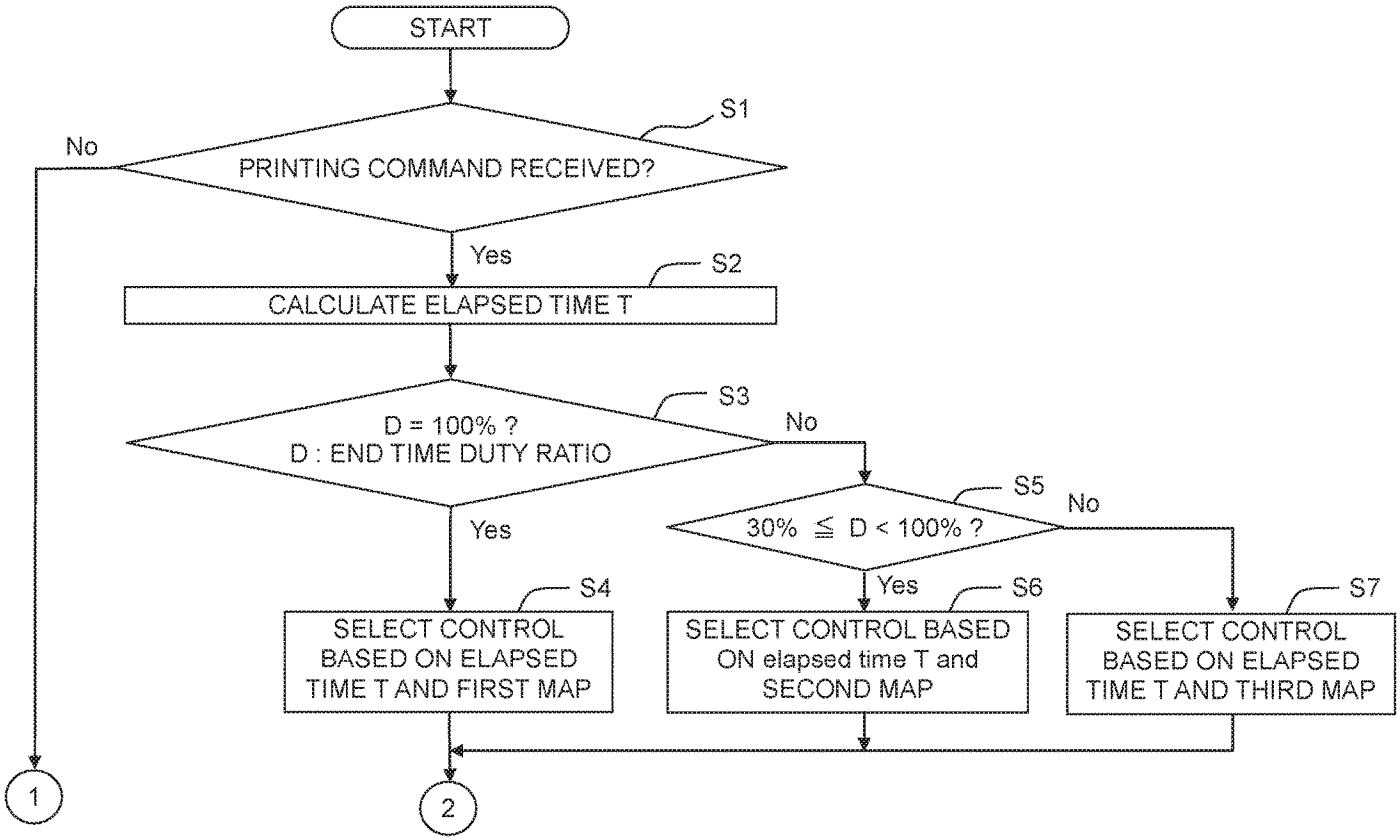
FIGS. 5A and 5B are a flowchart indicating operation of a controller.
Figure 5B:
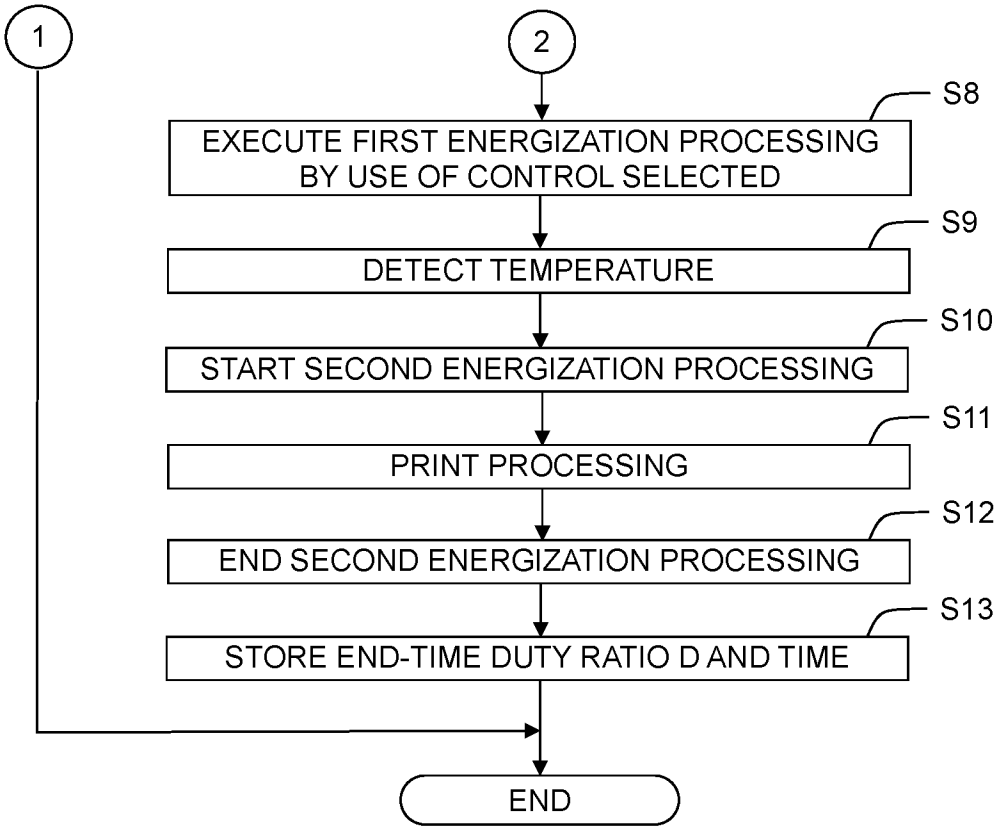

Referring to FIGS. 5A and 5B, operation of the controller 100 is explained in detail. The controller 100 determines whether a printing command has been received (S1). When the controller 100 has determined that no printing command is received (S1: No), the controller 100 ends this control.

When the controller 100 has determined that the printing command has been received (S1: Yes), the controller 100 calculates the elapsed time T that has elapsed after the second energization processing executed last time is ended (S2). After the step S2, the controller 100 determines whether the end-time duty ratio D is 100% (S3). When the second energization processing executed last time is ended, the end-time duty ratio D and the time at which the second energization processing executed last time is ended are stored in a storage, such as the RAM.

When the controller 100 has determined that the end-time duty ratio D is 100% (S3: Yes), the controller 100 selects the first map and then selects the first phase control, the second phase control, or the wavenumber control based on the first map and the elapsed time T (S4). When the controller 100 has determined that the end-time duty ratio D is not 100% (S3: No), the controller 100 determines whether the end-time duty ratio D is equal to or more than 30% and less than 100% (S5).

When the controller 100 has determined that the end-time duty ratio D is equal to or more than 30% and less than 100% (S5: Yes), the controller 100 selects the second map and then selects the first phase control, the second phase control, or the wavenumber control based on the second map and the elapsed time T (S6). When the controller 100 has not determined that the end-time duty ratio D is equal to or more than 30% and less than 100% (S5: No), the controller 100 selects the third map and then selects the first phase control, the second phase control, or the wavenumber control based on the third map and the elapsed time T (S7).

After the steps S4, S6, and S7, the controller 100 executes the first energization processing by use of the control selected (S8). When the controller 100 executes the first energization processing for the predefined time and then ends the first energization processing, the controller 100 starts temperature detection by the temperature sensor 32 (S9) and then starts the second energization processing based on the detection temperature (S10). The controller 100 may control the temperature sensor 32 to detect the temperature after starting the first energization processing. Then, the controller 100 may end the first energization processing when the detection temperature has reached a predefined temperature lower than the fixing temperature.

After the step S10, when a predefined condition for enabling execution of image formation (e.g., a condition that the heating member 22 has reached the fixing temperature) is satisfied, the controller 100 executes the print processing (S11) in which the conveyance of the sheet 5 is started, the developer image is formed by the process unit 6, and the developer image is fixed on the sheet 5 by the fixing unit 7. After the print processing, the controller 100 ends the second energization processing (S12). After the step S12, the controller 100 stores, in the storage, an end-time duty ratio D at the end of the second energization processing executed this time and time at which the second energization processing executed this time is ended (S13). Then, the controller 100 ends this control.

Subsequently, an example of operation of the controller 100 is explained. As depicted in FIG. 3A, when the end-time duty ratio D is 100% and the elapsed time T is equal to or less than four seconds at the start of the first energization control, the temperature of the filament and the impedance are high. The controller 100 thus energizes the filament by the wavenumber control. This rapidly increases the temperature of the filament, making it possible to execute the print processing promptly.

When the end-time duty ratio D is 100% and the elapsed time T is longer than four seconds at the start of the first energization control, the temperature of the filament and the impedance are low. The controller 100 thus energizes the filament by the second phase control or the first phase control. In that case, the filament is energized by the first energization pattern P1, namely, by the pattern by which energization is caused at parts except for the peak of the sine wave, thus preventing an excessive current from flowing through the filament. The temperature of the filament and the impedance when the first phase control is selected are lower than the temperature of the filament and the impedance when the second phase control is selected. The controller 100 thus executes the first phase control for a longer time than the second phase control. This satisfactorily prevents the excessive current from flowing through the filament in the first phase control, which takes more time, than the second phase control, to make the impedance of the filament return to a predefined value.

This embodiment can obtain the following effects. The laser printer 1 includes the heating member 22, the heat source 31, the temperature sense 32, the switching circuit 50 that supplies the current to the heat source 31, and the controller 100. The controller 100 can execute: the print processing of forming the image on the sheet 5; the first energization processing of supplying the current to the heat source 31 after the printing command is received and before the print processing is started; and the second energization processing of setting the duty ratio of the output current of the switching circuit 50 based on the detection result of the temperature sensor 32 and supplying the current to the heat source 31, in the print processing. When starting the first energization processing, the controller 100 sets the energization pattern based on the end-time duty ratio D and the elapsed time T that has elapsed after the second energization processing executed last time is ended. This allows the controller 100 to estimate the temperature of the filament of the heat source 31 at the start of the first energization processing, making it possible to select the energization pattern not causing the excessive current flowing through the filament.

When starting the first energization processing, the controller 100 can make the duty ratio of the energization pattern at the start of the first energization processing large as the end-time duty ratio D is larger. This can heat the heating member 22 rapidly.

The controller 100 can make the duty ratio of the energization pattern at the start of the first energization processing large as the elapsed time T that has elapsed after the second energization processing executed last time is ended is shorter. This can heat the heating member 22 rapidly.

At the start of the first energization processing, the controller 100 can execute the phase control. This can prevent an excessive current from flowing through the filament.

The present teaching is not limited to the above embodiment, and can be used in a wide variety of embodiments, as follows.

The sheet 5 may be, for example, a sheet or paper such as thick paper or heavy paper, a postcard, and thin paper, or may be an OHP (Over Head Projector) sheet.

In the above embodiment, the cylindrical fixing roller is an example of the heating member 22. The present teaching, however, is not limited thereto. The heating member 22 may be a nipping plate that nips an endless belt between itself and the heating member 22.

In the above embodiment, the halogen lamp, which includes the filament as the resistor and heats the heating member 22 by radiant heat, is an example of the heat source 31. The present teaching, however, is not limited thereto. The heat source 31 may be, for example, a ceramic heater that includes a resistance heating element and heats the heating member 22 by thermal conduction.

In the above embodiment, the controller 100 is configured to set the two energization patterns. The present teaching, however, is not limited thereto. The controller 100 may be configured to set three or more energization patterns.

In the above embodiment, the same energization pattern (the first energization pattern P1) is set in the first phase control and the second phase control. The present teaching, however, is not limited thereto. The first phase control and the second phase control may have mutually different energization patterns. In that case, for example, the duty ratio of the energization pattern set in the first phase control may be smaller than the duty ratio of the energization pattern set in the second phase control to make the first phase control and the second phase control have the same execution time.

In the above embodiment, the present teaching is applied to the laser printer 1. The present teaching, however, is not limited thereto. The present teaching may be applied to any other image forming apparatuses, such as a copying machine and a multifunctional peripheral.

The respective elements explained in the above embodiment and the modified examples may be used in a combined manner.

What is claimed is:

1. An image forming apparatus, comprising:

a heating member configured to fix a developer image on a sheet;

a heat source configured to heat the heating member;

a temperature sensor configured to acquire a temperature of the heating member;

a switching circuit configured to supply a current to the heat source by switching a voltage inputted from an alternating-current power source between an energization state and a non-energization state; and a controller configured to execute:

print processing of fixing the developer image on the sheet;

first energization processing of supplying the current to the heat source after a printing command is received and before the print processing is started; and second energization processing of setting a duty ratio of an output current of the switching circuit based on a detection result of the temperature sensor so that the heating member has a fixing temperature and supplying the current to the heat source, in the print processing, wherein, in a case that the first energization processing is started, the controller is configured to set an energization pattern based on an end-time duty ratio, which is a duty ratio when the second energization processing last executed ends, and elapsed time, which has elapsed after the second energization processing last executed ends, and wherein the controller is configured to start the second energization processing, in a case that the controller has determined, after the first energization processing is executed and based on the detection result of the temperature sensor, that the heating member has a predefined temperature which is lower than the fixing temperature.

2. The image forming apparatus according to claim 1, wherein the controller is configured to set, as the end-time duty ratio, an average duty ratio in a predefined period immediately before the second energization processing ends.

3. The image forming apparatus according to claim 1, wherein, in the case that the first energization processing is started, the controller is configured to increase a duty ratio of the energization pattern as the end-time duty ratio increases.

4. The image forming apparatus according to claim 1, wherein, in the case that the first energization processing is started, and that a duty ratio of the energization pattern is set to less than 50%, the controller is configured to execute phase control.

5. The image forming apparatus according to claim 1, wherein, in the case that the first energization processing is started, and that a duty ratio of the energization pattern is set to equal to or more than 50%, the controller is configured to execute wavenumber control.

6. The image forming apparatus according to claim 1, wherein the heat source is a lamp having a filament and is configured to heat the heating member by radiant heat.

7. The image forming apparatus according to claim 1, wherein, in the case that the first energization processing is started, the controller is configured to make a duty ratio of the energization pattern larger as the elapsed time, which has elapsed after the second energization processing last executed ends.

8. The image forming apparatus according to claim 7, wherein, in a case that the elapsed time, which has elapsed after the second energization process last executed ends, is longer than a first period of time, the controller is configured to execute phase control, and in a case that the elapsed time, which has elapsed after the second energization process last executed ends, is equal to or shorter than the first period of time, the controller is last configured to execute wavenumber control.

9. An image forming method using an image forming apparatus, the image forming apparatus comprising: a heating member configured to fix a developer image on a sheet; a heat source configured to heat the heating member; and a switching circuit configured to supply a current to the heat source by switching a voltage inputted from an alternating-current power source between an energization state and a non-energization state, the image forming method comprising:

print processing of fixing the developer image on the sheet;

first energization processing of supplying the current to the heat source after a printing command is received and before the print processing is started; and second energization processing of setting a duty ratio of an output current of the switching circuit based on a temperature of the heating member so that the heating member has a fixing temperature and supplying the current to the heat source, in the print processing, wherein, in a case that the first energization processing is started, an energization pattern is set based on an end-time duty ratio which is a duty ratio when the second energization processing last executed ends, and elapsed time, which has elapsed after the second energization processing last executed ends, and wherein the second energization processing is started, in a case that the heating member has a predefined temperature which is lower than the fixing temperature, after the first energization processing is executed.

10. The image forming method according to claim 9, wherein the end-time duty ratio is an average duty ratio in a predefined period immediately before the second energization processing is ended.

11. The image forming method according to claim 9, wherein, in the case that the first energization processing is started, a duty ratio of the energization pattern is made to be larger as the end-time duty ratio is larger.

12. The image forming method according to claim 9, wherein, in the case that first energization processing is started, and that a duty ratio of the energization pattern is set to less than 50%, phase control is executed.

13. The image forming method according to claim 9, wherein, in the case that first energization processing is started, and that a duty ratio of the energization pattern is set to equal to or more than 50%, wavenumber control is executed.

14. The image forming method according to claim 9, in the case that the first energization processing is started, a duty ratio of the energization pattern is made to be larger as the elapsed time, which has elapsed after the second energization processing last executed ends, is shorter.

15. The image forming method according to claim 14, wherein, in a case that the elapsed time, which has elapsed after the second energization processing last executed ends, is longer than a first period of time, phase control is executed, and in a case that the elapsed time, which has elapsed after the second energization process last executed ends, is equal to or shorter than the first period of time, wavenumber control is executed.

16. An image forming apparatus, comprising:

a heating member configured to fix a developer image on a sheet;

a temperature sensor configured to acquire a temperature of the heating member;

a heat source configured to heat the heating member;

a switching circuit configured to supply a current to the heat source by switching a voltage inputted from an alternating-current power source between an energization state and a non-energization state; and a controller configured to execute:

print processing of fixing the developer image on the sheet;

first energization processing of supplying the current to the heat source after a printing command is received and before the print processing is started; and second energization processing of setting a duty ratio of an output current of the switching circuit based on a detection result of the temperature sensor so that the heating member has a fixing temperature and supplying the current to the heat source, in the print processing, wherein, in a case that the first energization processing is started, the controller is configured to set an energization pattern based on an end-time duty ratio, which is a duty ratio when the second energization processing last executed ends, and elapsed time, which has elapsed after the second energization processing last executed ends, wherein in the case that the first energization processing is started, in a case that the elapsed time, which has elapsed after the second energization process last executed ends, is longer than a first period of time, the controller is configured to execute phase control, and in a case that the elapsed time, which has elapsed after the second energization process last executed ends, is equal to or shorter than the first period of time, the controller is configured to execute wavenumber control, and in a case of executing the wavenumber control, the controller is configured to make the duty ratio of the energization pattern larger than a case of executing the phase control.

17. The image forming apparatus according to claim 16, wherein, in the case that the first energization processing is started, the controller is configured to make the first period of time longer as the end-time duty ratio increases.

18. The image forming apparatus according to claim 17, wherein in a case of executing the phase control, in a case that the elapsed time, which has elapsed after the second energization process last executed ends, is longer than a second period of time, the controller is configured to execute first phase control, and in a case that the elapsed time, which has elapsed after the second energization process last executed ends, is equal to or shorter than the first period of time and equal to or shorter than the second period of time, the controller is configured to execute second phase control, and wherein the controller is configured to make the duty ratio of the energization pattern larger than in a case of executing the phase control.

* * * * *